US007326458B1

(12) United States Patent
Zagorski

(10) Patent No.: US 7,326,458 B1
(45) Date of Patent: Feb. 5, 2008

(54) SYSTEM AND METHOD FOR FLEXIBLE INSULATION

(76) Inventor: Stephen W. Zagorski, P.O. Box 50196, Austin, TX (US) 78763

( * ) Notice: Subject to any disclaimer, the term of this patent is extended or adjusted under 35 U.S.C. 154(b) by 69 days.

(21) Appl. No.: 10/702,829

(22) Filed: Nov. 6, 2003

(51) Int. Cl.
*B32B 1/00* (2006.01)
*B32B 3/00* (2006.01)
*E04C 2/34* (2006.01)

(52) U.S. Cl. ..... 428/178; 428/72; 428/166; 52/793.1

(58) Field of Classification Search ..... 428/43, 428/69, 72, 156, 166, 172, 178; 52/793.1, 52/796.1
See application file for complete search history.

(56) References Cited

U.S. PATENT DOCUMENTS 3,192,099 A * 6/1965 Beckman et al. ..... 428/71
3,195,686 A * 7/1965 Johnson ..... 428/604
3,832,263 A * 8/1974 Cleveland et al. ..... 428/57
4,535,828 A * 8/1985 Brockhaus ..... 160/84.04
4,709,688 A * 12/1987 Paradis ..... 126/566
4,804,578 A 2/1989 Crookston
4,889,252 A 12/1989 Rockom et al.
4,901,472 A 2/1990 Donohue et al.
4,989,688 A 2/1991 Nelson
5,009,326 A 4/1991 Reaves et al.
5,011,743 A 4/1991 Sheridan et al.
5,256,467 A 10/1993 Kato
5,405,671 A * 4/1995 Kamin et al. ..... 428/69
5,532,039 A 7/1996 Payne et al.
5,669,233 A 9/1997 Cook et al.
5,763,857 A 6/1998 Klement et al.
6,135,193 A 10/2000 Lloyd
6,214,438 B1 4/2001 Prick
6,220,388 B1 4/2001 Sanborn
6,221,456 B1 4/2001 Pogorski et al.
6,257,302 B1 7/2001 Bednarczyk et al.
6,296,134 B1 10/2001 Cardinale
6,391,469 B1 5/2002 Ragland et al.
6,418,687 B1 7/2002 Cox

* cited by examiner

*Primary Examiner*—Donald J. Loney

(57) ABSTRACT

An insulator is provided having a folded, stacked substrate with a plurality of insulating cells. The substrate is folded such that cells on one folded portion are interleaved with cells on another portion.

25 Claims, 17 Drawing Sheets

504c
504b
504a
502

509
508c
508b
508a
506

512c
512b
512a
510

516c
518
516b
516a
514

522
520c
520b
520a
518

526c
526b
526a
524

530c
530b
530a
528
532c
532b
532a 536c
536b
536a
534

542c
542b
542a
538
540

548c
548b
548a
544
546

556c
556b
556a
552
554
550

564c
564b
564a
560
562
558

572c
572b
572a
568
564
570
566

582c
582b
582a
578
574
576
580

584
516c
516b
516a 514
584
520c
520b
520a

518

586

586
584

584a 584b
586

SYSTEM AND METHOD FOR FLEXIBLE INSULATION

BACKGROUND OF THE INVENTION

1. Field of the Invention

The present invention relates to insulation systems and, in particular, to an improved thermal, impact, or acoustical insulation system.

2. Description of the Related Art

Insulating materials are used in building construction, packaging, and other applications to provide thermal, impact or acoustical resistance. Such materials are well known for their bulkiness and/or awkwardness of installation or use.

For example, fiberglass and acrylic fiber insulation is well known in the construction and housing industries. Such fiberglass and acrylic fiber insulation is typically formed of several inch thick fibers adhered to a paper or foil backing or just loose. Such insulation is usually delivered in compressed rolls and then unrolled at the construction site for installation. These rolls of fiber insulation tend to be relatively large and can compact during installation, particularly when wet thereby adversely affecting their consistency as an insulator. Further, fiberglass is known to contain and off gas Volatile Organic Compounds (VOCs) including formaldehyde, one of the major contributors to Sick Building Syndrome (SBS). In addition fiberglass has to be handled with care so as not to introduce fibers to the skin, lungs or eyes.

Similarly, blown fiber, or cellulose require construction workers or installers have to take special protective precautions while installing. Further, blown Fiber and Cellulose lack consistency in their installation, impede beneficial parallel air flow and are compromised by moisture Blown foam also has potential Volatile Organic Compounds that require protection for the installer. In addition blown foam is expensive, impedes beneficial parallel air flow and is difficult to remove or work around if changes occur during construction.

Alternatively, rigid foam panels may be used for insulation. However rigid foam panels are relatively expensive and lack the compressibility allowing unwanted perpendicular air movement at the edges, thus compromising its effectiveness as an insulator.

Finally, while foam and bubble-wrap type impact cushioning or protective insulators are known for container/shipping, these too suffer from awkwardness of use and/or installation. For example, bubble-wrap can require the uncoiling of a large roll and wrapping many layers around the object intended to be cushioned.

SUMMARY OF THE INVENTION

These and other drawbacks in the prior art are overcome in large part by a system and method according to the present invention.

A flexible insulator according to an embodiment of the present invention includes a folded, stacked substrate having a plurality of insulating cells. The substrate is folded such that cells on one folded portion are interleaved with cells on another portion.

In accordance with an embodiment of the present invention, an insulator includes a substrate having a plurality of creases for folding; insulating sub-panels formed on the substrate and positioned between predetermined creases, wherein the sub-panels include a plurality of insulating cells. In certain embodiments, pairs of the sub-panels comprise complementary spaced cells such that, when folded in a stacked accordion-like structure, cells on opposing panels are substantially adjacent and define a substantially uniform insulating barrier. Predetermined numbers of the cells may be air-filled or insulation filled.

A method for manufacturing an insulator according to an embodiment of the present invention includes providing a substrate having at least one set of substantially uniformly-spaced creases defining a plurality of sub-panels; forming a plurality of insulating cells in association with the plurality of sub-panels; and folding the substrate at the creases to define an accordion-like insulation panel. The cells may be placed in a complementary pattern on adjacent sub-panels such that when folded into the accordion-like insulation panel, cells on adjacent sub-panels define a substantially uniform insulation barrier. An adhesive sheet may be applied of one or more sides of the insulation panel.

A method for making an insulator according to another embodiment of the present invention includes forming groups of cells in or on a first substrate, the groups being substantially uniformly spaced at regular intervals on said first substrate; folding said substrate to form a stacked structure at intervals between said such that cells in a first group are adjacently offset cells in a second group; and sealing one edge of said stacked structure. The cells may be formed either by applying indentations in the substrate and then overlaying the indentations with another sheet, or may be adhesively dropped onto the substrate.

BRIEF DESCRIPTION OF THE DRAWINGS

A better understanding of the invention is obtained when the following detailed description is considered in conjunction with the following drawings in which.

DETAILED DESCRIPTION OF THE INVENTION

Figure 1A:
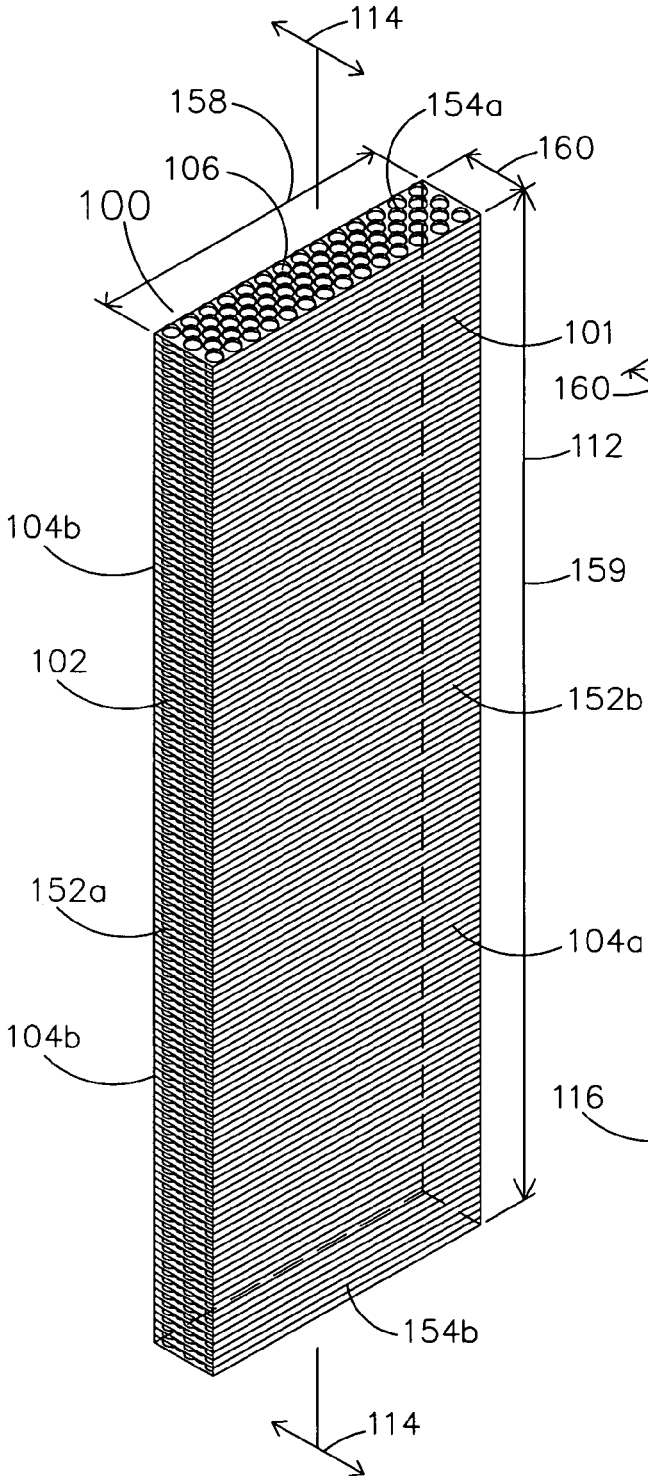
FIG. 1A and FIG. 1B illustrate an exemplary insulation panel according to an embodiment of the present invention.
Figure 1B:
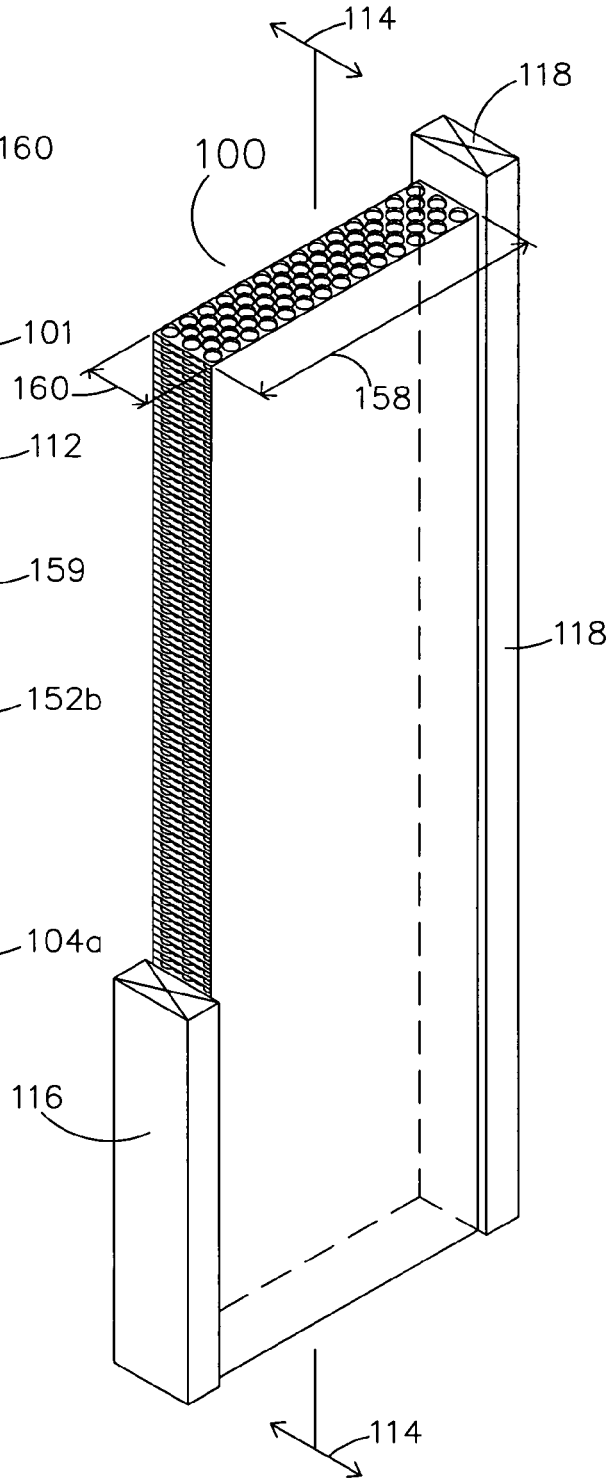

Turning now to the drawings and, with particular attention to FIG. 1A and FIG. 1B, a diagram of an exemplary finished insulation panel according to an embodiment of the present invention is shown and generally identified by the reference numeral 100. The insulation panel may be suitable for use as a thermal, acoustical, or impact insulator. The panel 100 has a width 158, height 159, and thickness or depth 160. As shown, the panel 100 is configured to provide a barrier, such as a thermal, acoustical, or impact barrier, in the direction of arrow 114. Thus, the panel 100 includes faces 104*a*, 104*b*, generally perpendicular the insulation axis 114; sides 152*a*, 152*b*; top 154*a*, and bottom 154*b*.

As shown, the insulation panel 100 may be implemented as an accordion-like structure having a plurality of stacked sub-panels 102 parallel to the insulative axis defined by folds or creases 101 alternating on faces 104*a*, 104*b*. An "end" sub-panel 102 forms the top 154*a* of the insulating panel 100; a corresponding end sub-panel forms the bottom 154*b*. The set of alternating folds 101 defines the faces 104*a*, 104*b*. The sides 152*a*, 152*b* are defined by the resulting "zig-zag" pattern of folded, stacked sub-panels.

The panel 100 may be embodied as any suitable flexible material, such as plastic, foil, paper, and the like. A predetermined number of the sub-panels 102 may include insulating cells 106. The cells 106 may be air-filled, or filled with a predetermined insulation material. As will be explained in greater detail below, the cells may be formed integrally within the substrate or laid upon the surface of the substrate. In addition, as will be described in greater detail below, the folds may be defined by creases or indentations in the panel substrate, or merely by groupings of the cells themselves. The sub-panels may be secured to one another by a suitable adhesive along sub-panel faces, or by adhesive layers along one or more sides of the panel 100. It is noted that, in certain embodiments, each sub-panel may itself form a single cell. In certain embodiments, insulative foil may be placed or adhered to the panel 100 so as to provide an additional thermal barrier.

The implementation shown in FIG. 1A may be particularly suited for use as an insulator in building construction. Thus, shown in FIG. 1B is insulating panel 100 and studs 116, 118. Studs 116, 118 may be standard wall studs, i.e., two-by-fours, used in wall construction. Thus, the depth 160 and width 158 of each sub-panel 102 (and hence the end 154) may be selected such that the insulating panel 100 can fit between the studs 116, 118, and coverings such as drywall placed on either side of the studs. The insulating panel 100 thereby provides, e.g., a thermal barrier in the direction of axis 114. It is noted, however, that while illustrated in the context of an insulating panel for the construction industry, embodiments of the present invention are equally suited for use as packaging material.

Figure 2A:
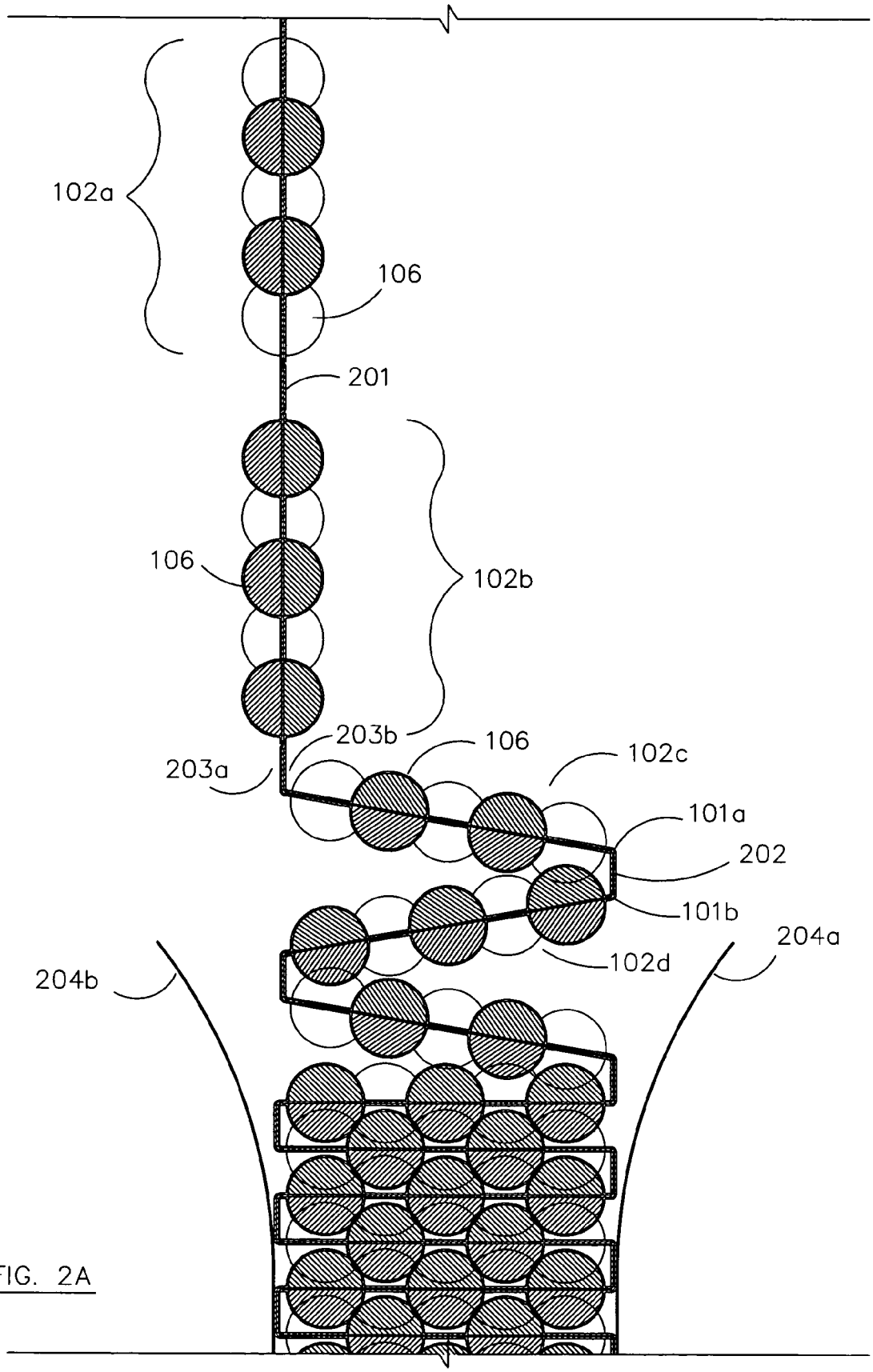
FIGS. 2A-2D schematically illustrate exemplary insulation panels according to embodiments of the present invention.

Exemplary insulation panels are shown schematically in sectional view in FIG. 2A-2D. As noted above, the insulation panel 100 may be implemented as a sheet of sub-panels folded in an accordion-like fashion. As shown in FIG. 2A, the insulation panel 100 can include a substrate 201 and a plurality of substantially uniformly spaced apart sub-panels 102*a*-102*d*. The substrate may be formed with any suitable material, such as plastic, or foil, or foil-coated plastic. In the embodiment illustrated, folds 101*a*, 101*b* between each sub-panel 102*a*-102*b* defines a hinge panel 202, which may be about a cell thickness in length. As shown, the cells 106 may be formed on both sides 203*a*, 203*b* of the substrate 201. As will be explained in greater detail below, the cells 106 may be formed integrally with the substrate 201, or may be deposited on the substrate 201. In addition, as will be explained in greater detail below, the cells 106 on adjacent sub-panels 102*a*, 102*b* may be positioned in complementary patterns, such that, when folded, the cells on opposing sub-panels are interleaved and a substantially uniform insulating layer 203 is provided. In other embodiments, the cells need not be interleaved; also, in other embodiments, the hinge panel 202 may be replaced simply with a single hinge fold. Finally, in the embodiment illustrated, one or more sheets 204*a*, 204*b* may be provided to one or more sides of the insulating panel 100. Such sheets may be, for example, a plastic or foil with an adhesive on one side. It is noted that the folds 101*a*, 101*b* may be formed from creases in the substrate material, perforations or scoring in the substrate material, or may be formed simply through an inherent flexibility in the substrate material.

Figure 2B:
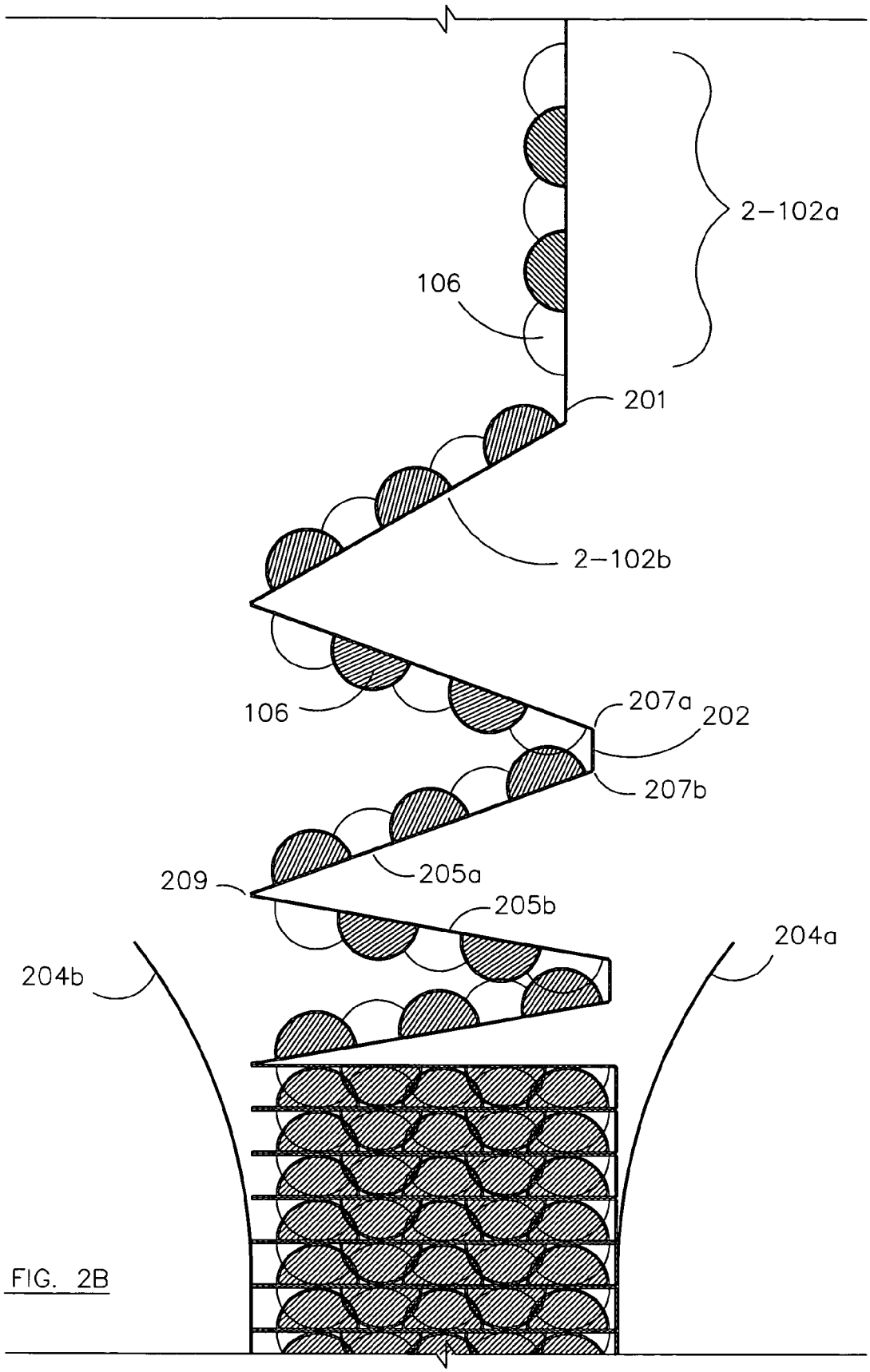

FIG. 2B illustrates another embodiment of the insulation panel 100 according to the present invention. In particular, in the embodiment shown in FIG. 2B, the insulative cells 106 are provided on only one side of the substrate 201. Because the cells 106 are provided on only on side of the substrate 201, the creases or folds and consequently, the sub-panels 2-102*a*, 102*b*, are configured slightly differently than in FIG. 2A. In particular, as shown, a single crease or folding point 209 is provided between alternate sub-panels. That is, a single crease 204 is provided where the "flat" sides 205*a*, 205*b* of the substrate would be in contact when folded; in contrast, a pair of creases or fold points 207*a*, 207*b* is provided is provided to define hinge panel 202 where the cell side is in contact when folded. As in the embodiment of FIG. 2A, in the embodiment of FIG. 2B, the cells on opposing sub-panels may be interleaved.

Figure 2C:
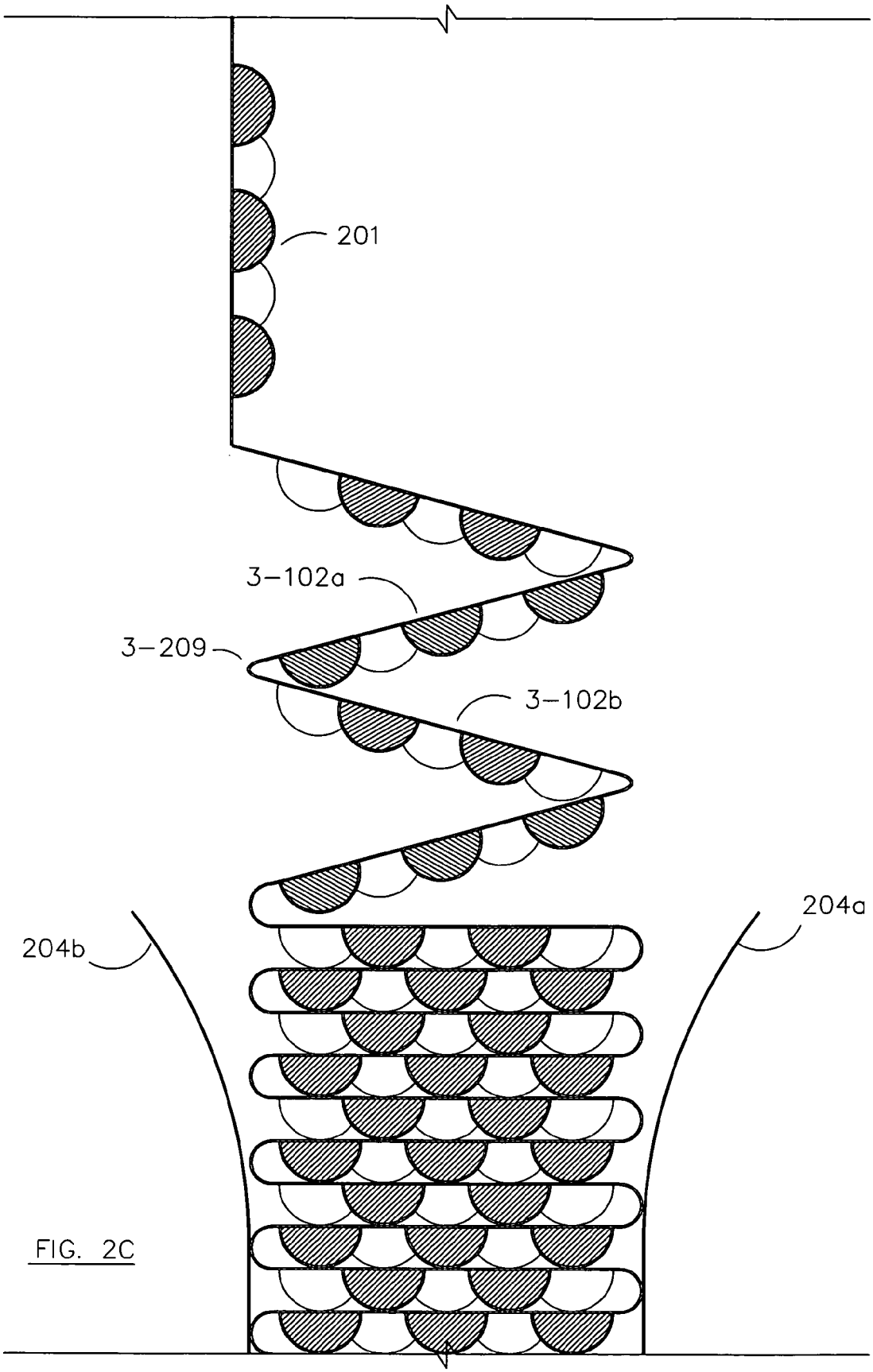

FIG. 2C illustrates another embodiment of the present invention. In particular, in the embodiment shown in FIG. 2C, the insulative cells 106 are provided in alternating fashion on opposite sides of the substrate 201. That is, the cells 106 are on opposite sides of adjacent sub-panels 3-102*a*, 3-102*b*, with fold 3-204 separating the sub-panels. Again, sheets 204*a*, 204*b* may be provided to the faces of the panels.

Figure 2D:
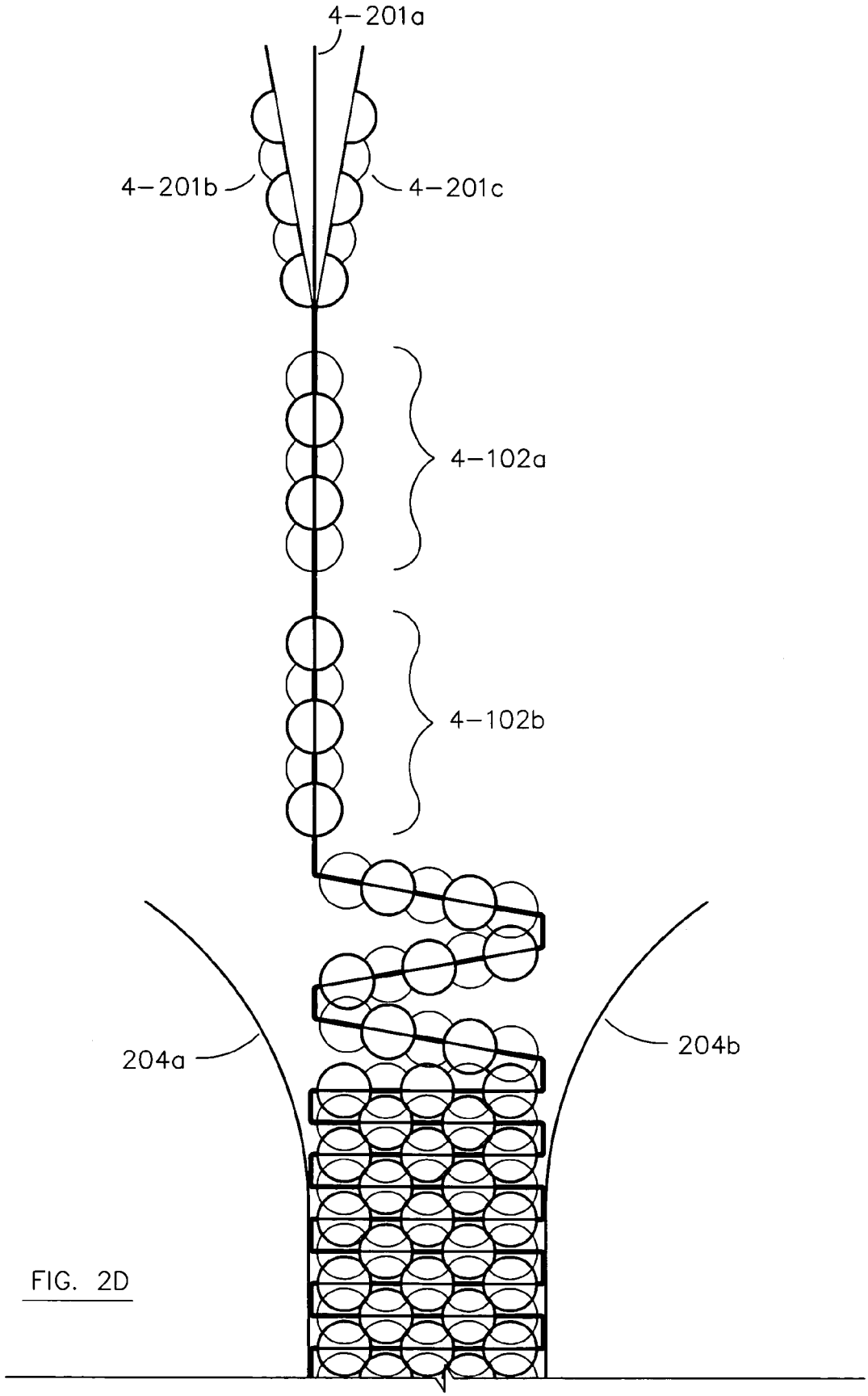

FIG. 2D illustrates another embodiment of the insulation panel 100 according to the present invention. In the embodiment of FIG. 2D, one or more sheets with insulative cells on a single side are adhered to a central substrate. More particularly, shown is central substrate 4-201*a*. One or more single-sided sheets based on substrates 4-201*b*, 4-201*c* are then adhered to substrate 4-201*a* to define the sub-panels 4-102*a*, 4-102*b* that are folded to form the insulative panel.

Figure 3A:
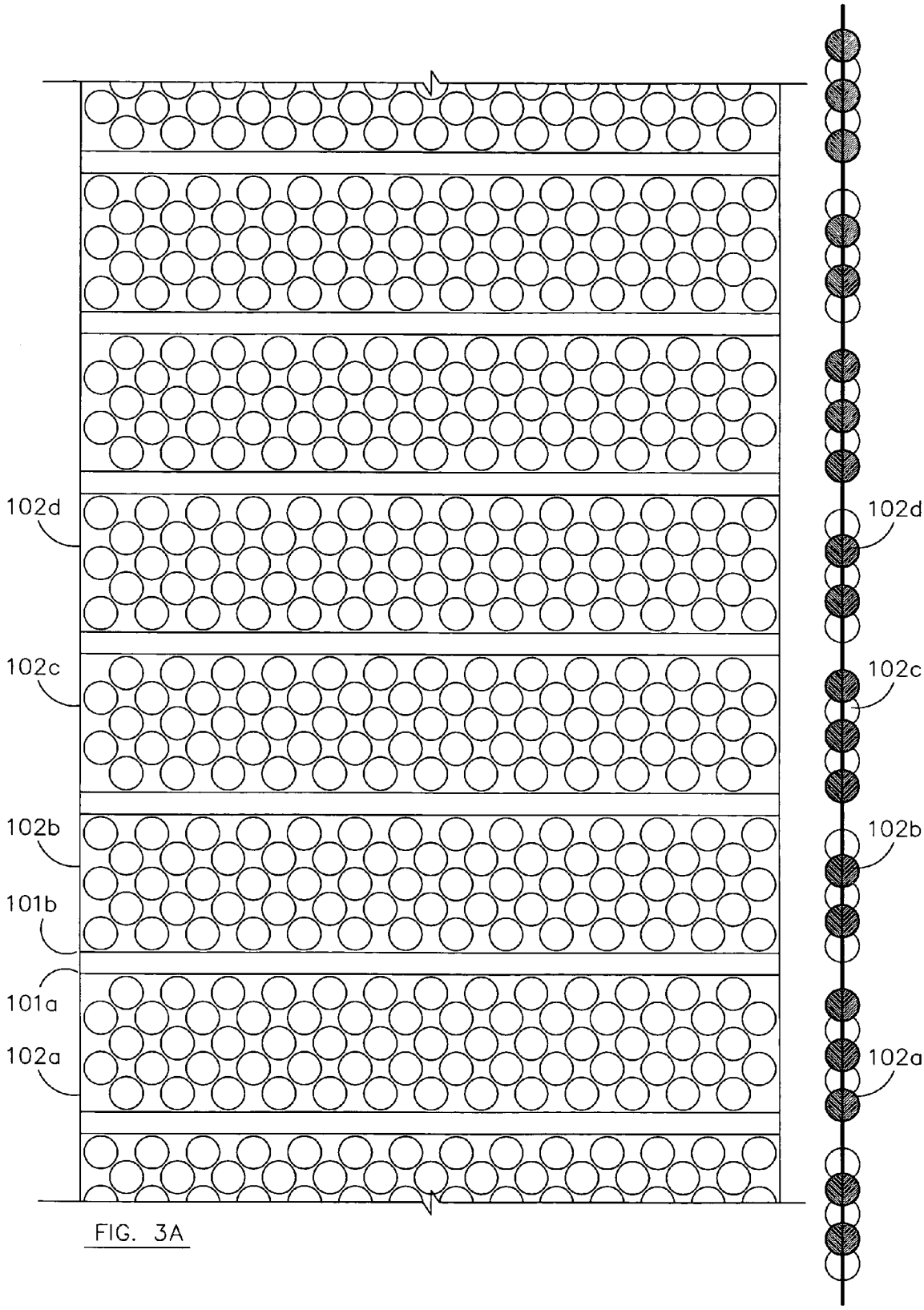
FIG. 3A and FIG. 3B illustrate cell patterning according to embodiments of the present invention.
Figure 3B:
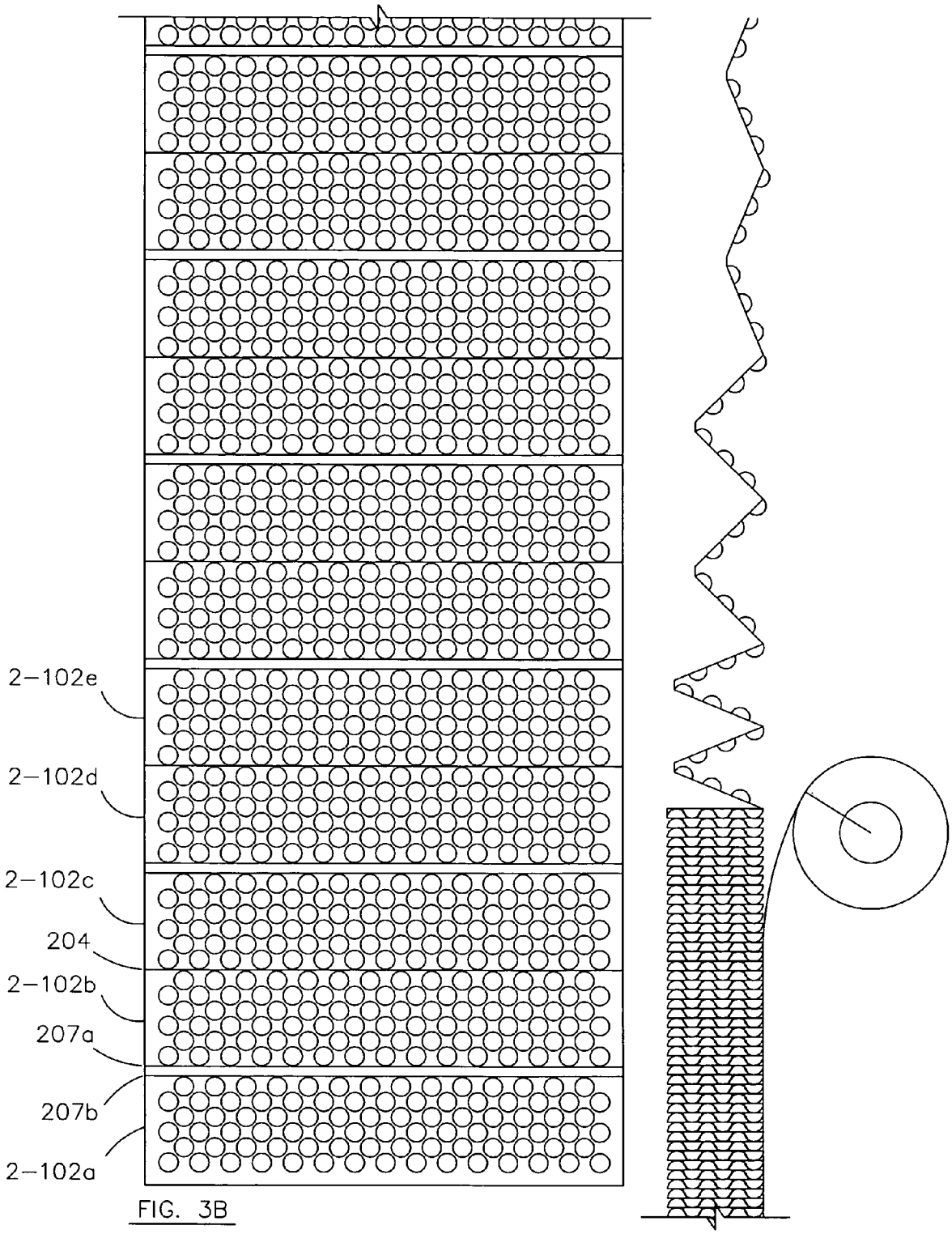

As noted above, in certain embodiments, the cells may be arranged in complementary patterns such that, when folded together, the cells on adjacent panel faces are interleaved. Exemplary cell configuration is shown in FIGS. 3A and 3B. It is noted, however, that alternate configurations are possible. Further, it is noted that in other embodiments, the cells need not be interleaved.

Shown in FIG. 3A is an exemplary configuration for the "double-sided" structure of FIG. 2A. That is, groups of cells are formed on either side of each sub-panel. More particularly, shown in FIG. 3A are a plurality of sub-panels 102*a*-102*d* and folds 101*a*, 101*b*. As can be seen in the embodiment illustrated adjacent sub-panels 102*a*, 102*b* have complementary cell patterns. For example, sub-panel 102*a* has a "2-3-2" pattern, while sub-panel 102*b* has a 3-2-3 cell pattern. Thus, when folded over at the folds 101*a*, 101*b*, the cells on one face 102*a* will interleave with those on face 102*b*.

It is noted that, while a 2-3-2 and 3-2-3 pattern is shown, other complementary patterns are envisioned. In addition, it is noted that, while illustrated as generally circular cells, the invention is not so limited. The cells 106 may, for example, have a hexagonal or other shape, such that, in certain embodiments, a cell from one sub-panel can fit in the recess or hole formed or located between cells on adjacent sub-panels. Further, it is noted that while in certain embodiments, the folds 101*a*, 101*b* are imprinted creases or otherwise "marked" or perforated into the substrate, in other embodiments, the substrate may be sufficiently flexible on its own that the material is capable of folding without scoring.

Shown in FIG. 3B is an exemplary configuration for the "single-sided" structure of FIG. 2B. That is, cells are formed on only one side of the substrate. More particularly, shown are a plurality of sub-panels 2-102*a*-2-102*d* and folds 204, 207*a*, 207*b*. In this embodiment, pairs of sub-panels are separately alternately by one fold 204 or two folds 207*a*, 207*b*. That is, the pairs of panels that fold "flat-side" to "flat-side" are separated by the single fold 204; the sub-panel pairs that fold cell-side to cell-side are separated by two folds 207*a*, 207*b*.

FIG. 3B also illustrates an alternative cell pattern according to an embodiment of the present invention. In this embodiment, the groups of cells 106 on each sub-panel have 3-3-3 pattern. However, the spacing of the groups of cells, i.e., single or double fold, is such that when folded, the cells on adjacent sub-panels folded cell-side to cell-side are interleaved with one another.

Exemplary methods for manufacturing insulative panels according to embodiments of the present invention are shown in FIGS. 4A-4E.

Figure 4A:
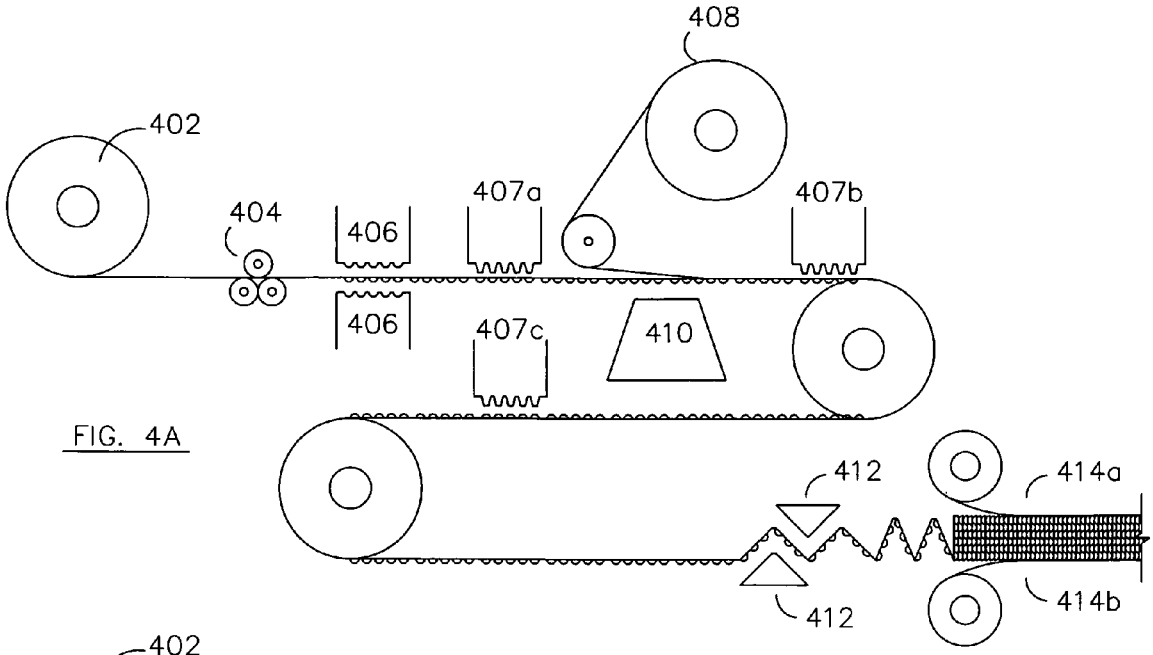
FIGS. 4A-4E illustrate manufacturing an insulator according to an embodiment of the present invention.

Turning now to FIG. 4A, a diagram schematically illustrating a method for manufacturing an insulator according to an embodiment of the present invention is shown. As shown at 402, a substrate may be provided. Typically, the raw substrate may be provided as a rolled sheet of a plastic or similar material. The substrate is then unrolled at 404 and fed to a cell-forming device 406. The cell-forming device 406 may be any press suitable for forming the desired dimpled cell pattern into the substrate, such as by thermally forming the pattern. Alternatively, if the substrate is heated, a vacuum could be applied at 406 in the desired pattern to form the cells. The cells may be filled at 407*a*, such as by depositing a foam, fiber, or other suitable material. At 408, a cover sheet may be provided to the top of the substrate, and may be heat and pressure sealed in place, as shown at 410. In other embodiments, the material could be rolled hot so as to adhere naturally. The cover sheet may be made of the same material as the substrate, or may, e.g., be a foil sheet. As shown at 407*b*, 407*c*, the cells could be filled after the cover sheet is provided, by injecting a material into the cells, from either the top of bottom. At this time, a press may also be used to score the substrate from either the top or bottom, to define creases or perforations for folding. At 412, the substrate may be folded, either at the creases or at the other designated points. Finally, at 414*a*, 414*b*, one or more facing sheets may be attached to either or both of the faces of the resulting panel.

It is noted that FIG. 4A illustrates one method for manufacturing a single-sided cell insulator according to en embodiment of the present invention. A similar process may be used to manufacture the double-sided insulator; in that case, pairs of single-sided insulators may be adhered to each other, either before or after the cover sheet is applied at 408.

Figure 4B:
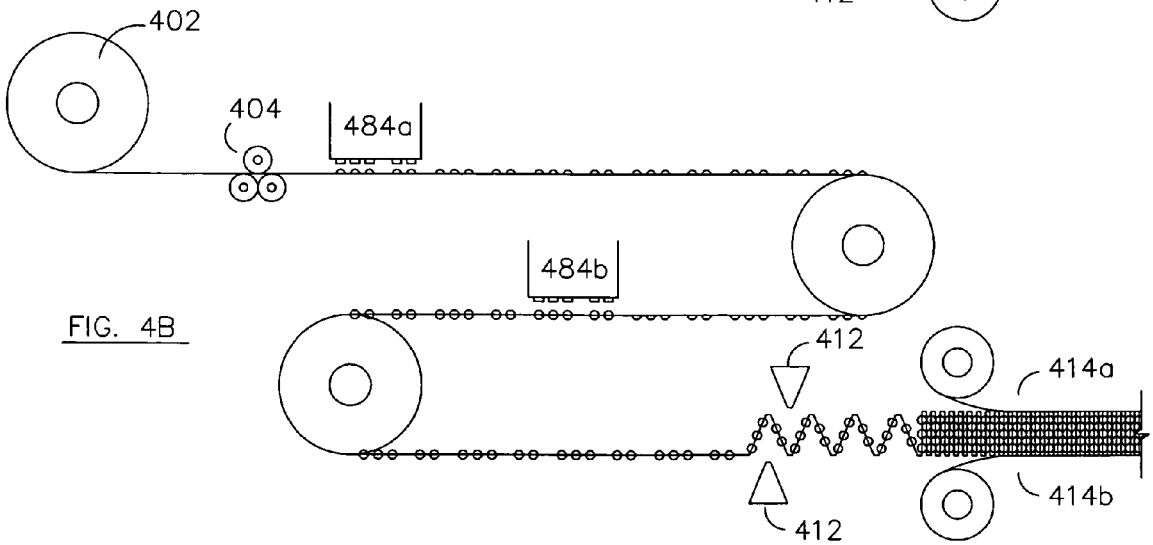

FIG. 4B illustrates another method for manufacturing an insulator according to the present invention. In particular, shown in FIG. 4B is a method for manufacturing a double-sided insulator, although a similar technique could be used for the single-sided insulator. At 402, a substrate, such as a rolled sheet of plastic or other material, is provided and unrolled at 404. At 484*a* and 484*b*, cells are deposited or dropped onto the substrate. The cells may be dropped in a liquid or relatively viscous form, that will later solidify, or may be solid cells that are applied to the substrate with a suitable adhesive. That is, in this embodiment, the cells may be applied by extruding a suitable material onto the substrate and then adhering by heating. Alternatively, the cells could already be relatively solid and simply applied by adhesive or, again, by heating. If desired, the substrate can then be "flipped" and cells applied to the other side. At this time, a press may be used to score the substrate, to define creases or perforations for folding. At 412, the substrate may be folded, either at the creases or at the other designated points. Finally, at 414*a*, 414*b*, one or more facing sheets may be attached to either or both of the faces of the resulting panel.

Figure 4C:
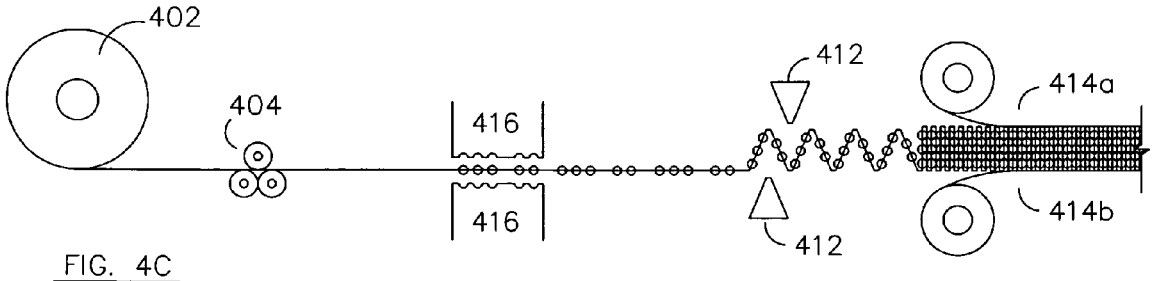

FIG. 4C illustrates another method for manufacturing an insulator according to the present invention. This embodiment may be particularly suited to use of a substrate formed from a suitable flexible mesh material having a grid with the same pattern. Initially, at 402, a substrate is provided and is unrolled at 404. At 416, cells may be provided by injecting them into the pattern in the mesh. At 412, the substrate may be folded, either at the creases or at the other designated points. Finally, at 414*a*, 414*b*, one or more facing sheets may be attached to either or both of the faces of the resulting panel.

Figure 4D:
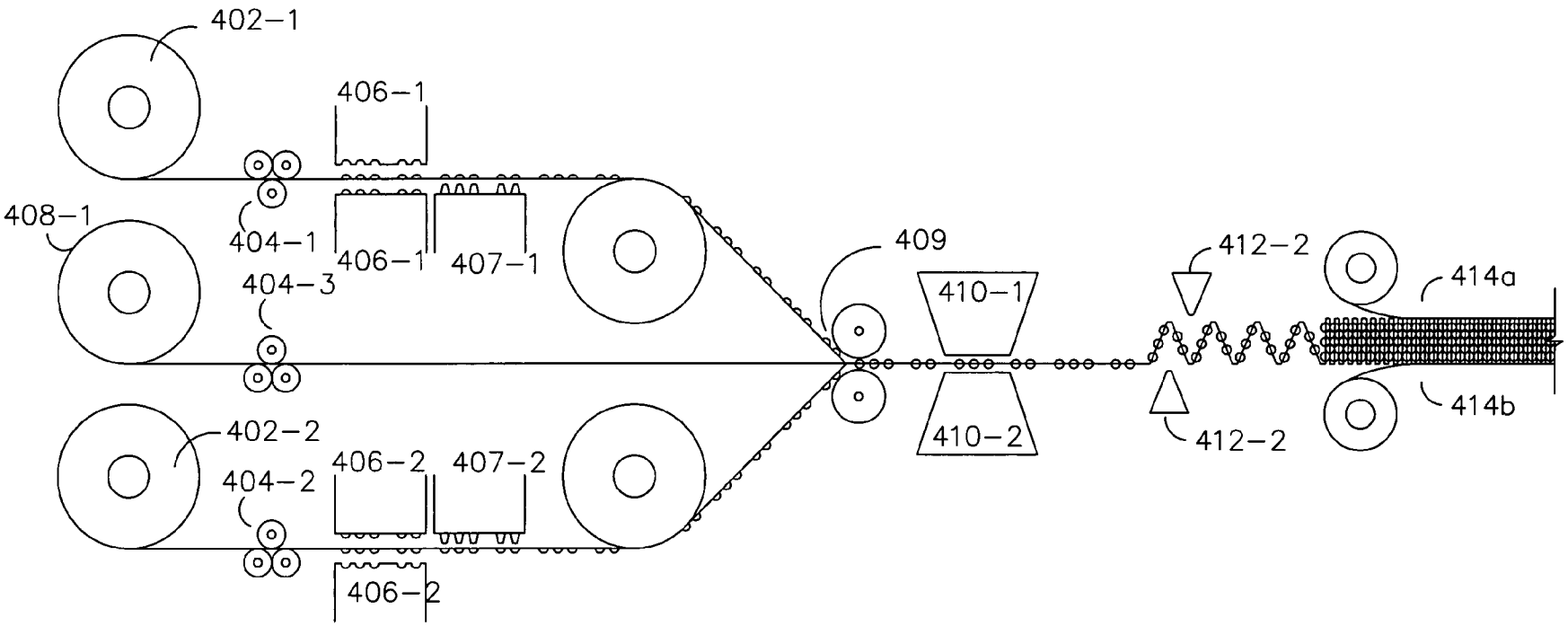

FIG. 4D illustrates another method of manufacturing an insulator according to the present invention. In FIG. 4D, a central substrate is sandwiched between two other substrates having the cells formed therein or thereon. In particular, at 402-1 and 402-2, outer substrates are provided, and unrolled at 404-1, 404-2, respectively. A central substrate is provided at 408-1 and is unrolled at 404-3. At 406-1, 406-2, cells may be formed into the outer substrates. At 407-1, 407-2, the cells may be filled. The sheets of the substrate are brought together at 409 and adhered at 410-1, 410-2. At 412-1, 412-2, the substrate may be folded, either at the creases or at the other designated points. Finally, at 414*a*, 414*b*, one or more facing sheets may be attached to either or both of the faces of the resulting panel.

Figure 4E:
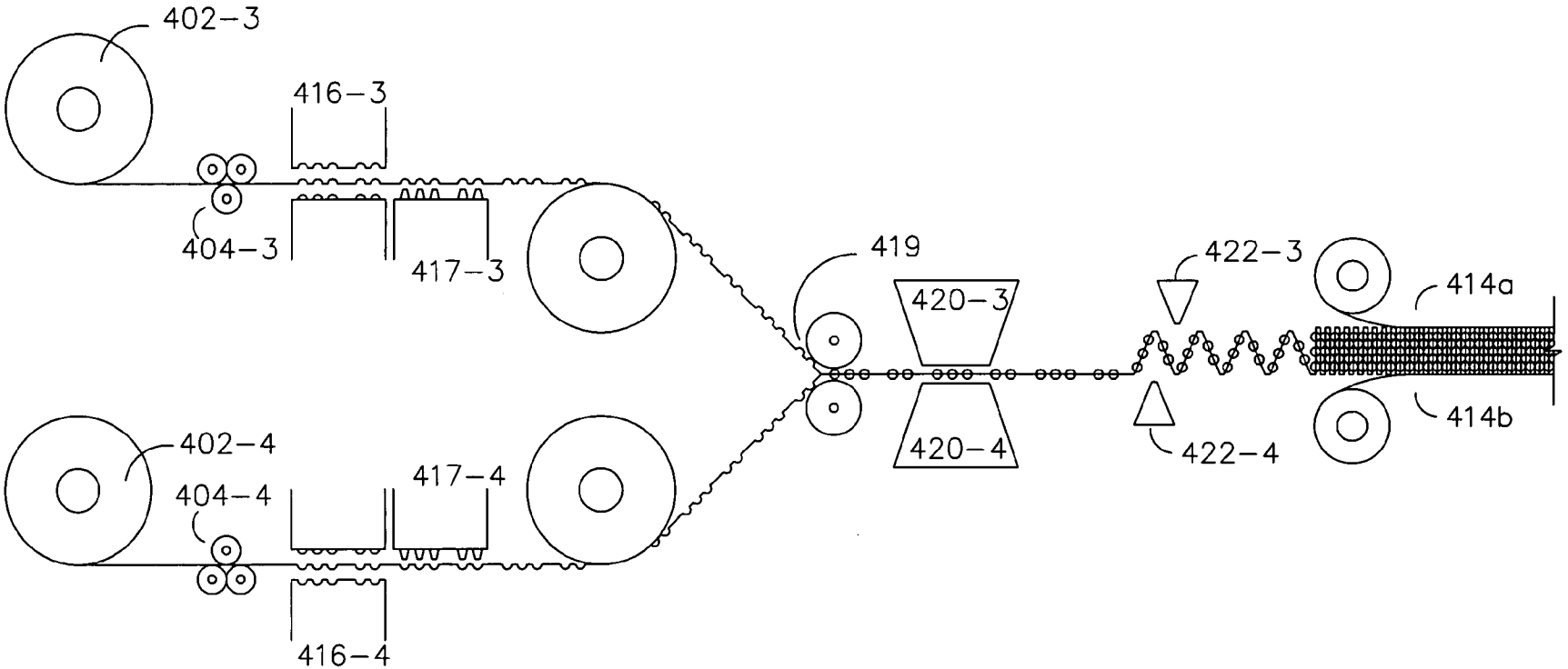

FIG. 4E illustrates another method of manufacturing an insulator according to the present invention. In FIG. 4E, two separate substrates having formed cells therein or thereon are fused together. In particular, at 402-3 and 402-4 outer substrates are provided and unrolled at 404-3 and 404-4 respectively. At 416-3 and 416-4 cells may be formed into the two separate substrates. For example, the cells may be formed by making indentations into the substrates. At 417-3 and 4174 the cells may be filled. The sheets of substrate are brought together at 419 and adhered at 420-3 and 420-4. At 422-3 and 422-4 the substrates may be folded, either at the creases or at other designated points. Finally, at 414*a*, 414*b* one or more facing sheets may be attached to either or both of the faces of the resulting panel.

It is noted that these embodiments are exemplary only. For example, the cells may be formed by injecting bubbles into a suitable substrate of predetermined thickness; further, additional layers of protective or insulative material may be applied to either side of the substrates, i.e., those with or without exposed cells.

Figures 5A, 5B, 5C, 5D, 5E, 5F, 5G:
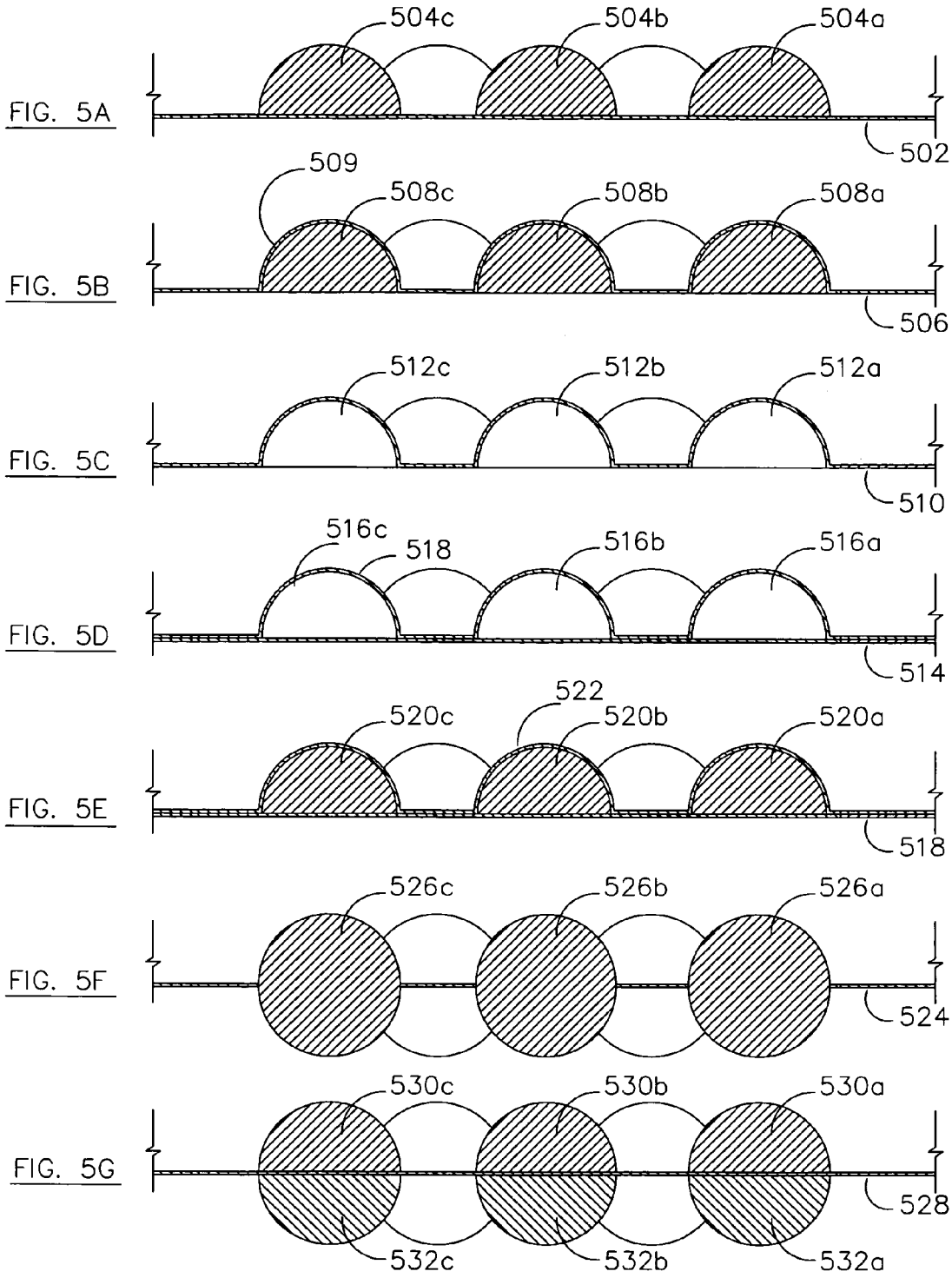
FIG. 5A-5AA illustrate various cell configurations for insulators according to embodiments of the present invention.

Turning now to FIGS. 5A-5AA, various configurations for the cells and sub-panels are shown. Each embodiment is foldable, e.g., at the edges. That is, the figures show exemplary single sub-panels.

Shown in FIG. 5A is a basic configuration including a substrate 502 and cells 504*a*-504*c*, which may be applied to the substrate 502 by extrusion or dripping, or even individual placement, followed by adhesion. FIG. 5B illustrates an insulator having a dimpled substrate 506. The dimples 509 are filled with an insulating material 508*a*-508*c*.

The embodiment of FIG. 5C shows an insulator having a dimpled substrate 510 and cells 512*a*-512*c*. In this embodiment, the cells 512*a*-512*c* are left open. When the sub-panels are layered, they will effectively be closed, however.

FIG. 5D illustrates an insulator having a substrate 518 and cells 516*a*-516*c* formed by dimpling in the substrate. An additional layer 514 may be applied to the faces of the cells.

FIG. 5E illustrates an embodiment similar to that of FIG. 5D, but in which the cells are filled with an insulative material. Thus, a substrate 522 having dimples 520*a*-520*c* is formed, and a layer 518 provided over it. The cells may then be filled with a suitable insulative material.

FIG. 5F illustrates an embodiment in which the substrate 524 is embodied as a mesh, with cells 526*a*-526*c* formed by injecting from either side. FIG. 4C illustrates one method of manufacturing such an insulator.

FIG. 5G illustrates a double-sided embodiment similar to that of FIG. 5A. In particular, cells 530*a*-530*c* may be applied to one side of a substrate 528 and cells 532*a*-532*c* may then be applied to the other side of the substrate.

Figures 5H, 5I, 5J, 5K, 5L, 5M, 5N:
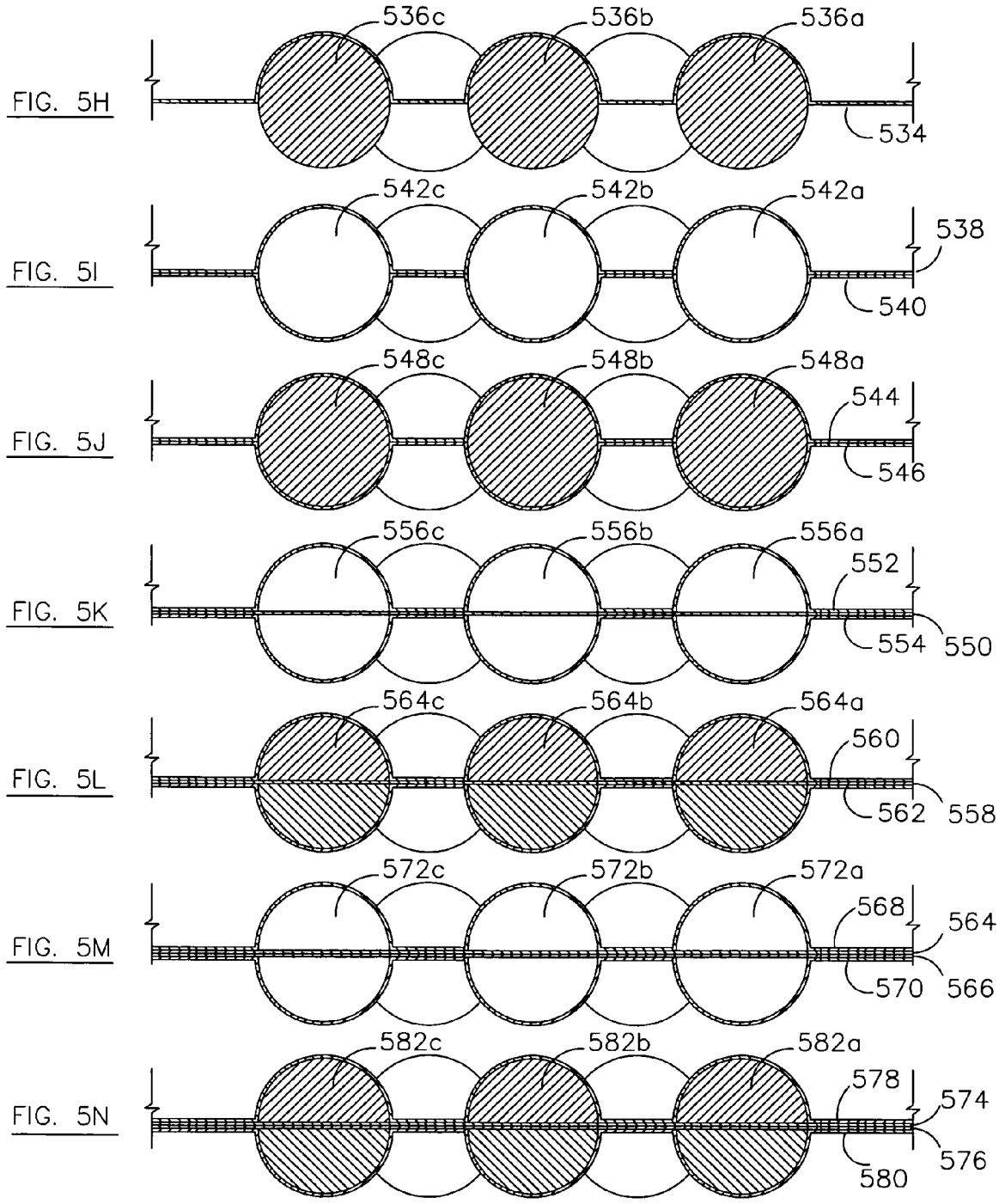

FIG. 5H illustrates an embodiment similar to that of FIG. 5B, in that a dimpled base substrate 534 is used, but filled or double-sided cells 536*a*-536*c* are used to fill or overfill the dimples.

FIG. 51 illustrates an embodiment having a dimpled substrate 538 and a dimpled substrate 540 fixed face to face, to form double-sided dimples 542*a*-542*c*. Similarly, FIG. 5J illustrates a filled, dimpled substrate 544 face-to-face with a filled dimpled substrate 546, to form double-sided dimples 548*a*-548*c*.

FIG. 5K illustrates an embodiment having a substrate 550 fixed to dimpled layers 552 and 554 to form paired dimples 556*a*-556*c*. Similarly, FIG. 5L illustrates an embodiment having substrate 558 fixed to dimpled layers 560, 562 to form dimples 564*a*-564*c*. In this case, the dimples may be filled with an insulating material. FIG. 4D illustrates one method of manufacturing such an insulator.

FIG. 5M illustrates an insulator having a substrate 568 and cells 572*a*-572*c*. A layer 564 may be applied to the faces of the cells. Another substrate 570 is also provided with cells and a facing layer 566 is applied. The facing layers 564, 566 are then affixed. The embodiment of FIG. 5N is similar to that of FIG. 5M, but includes filled cells. That is, FIG. 5N illustrates an insulator having a substrate 578 and cells 582*a*-582*c*. A layer 574 may be applied to the faces of the cells. Another substrate 580 is also provided with cells and a facing layer 576 is applied. The facing layers 574, 576 are then affixed.

Figures 5O, 5P, 5Q, 5R, 5S, 5T, 5U:
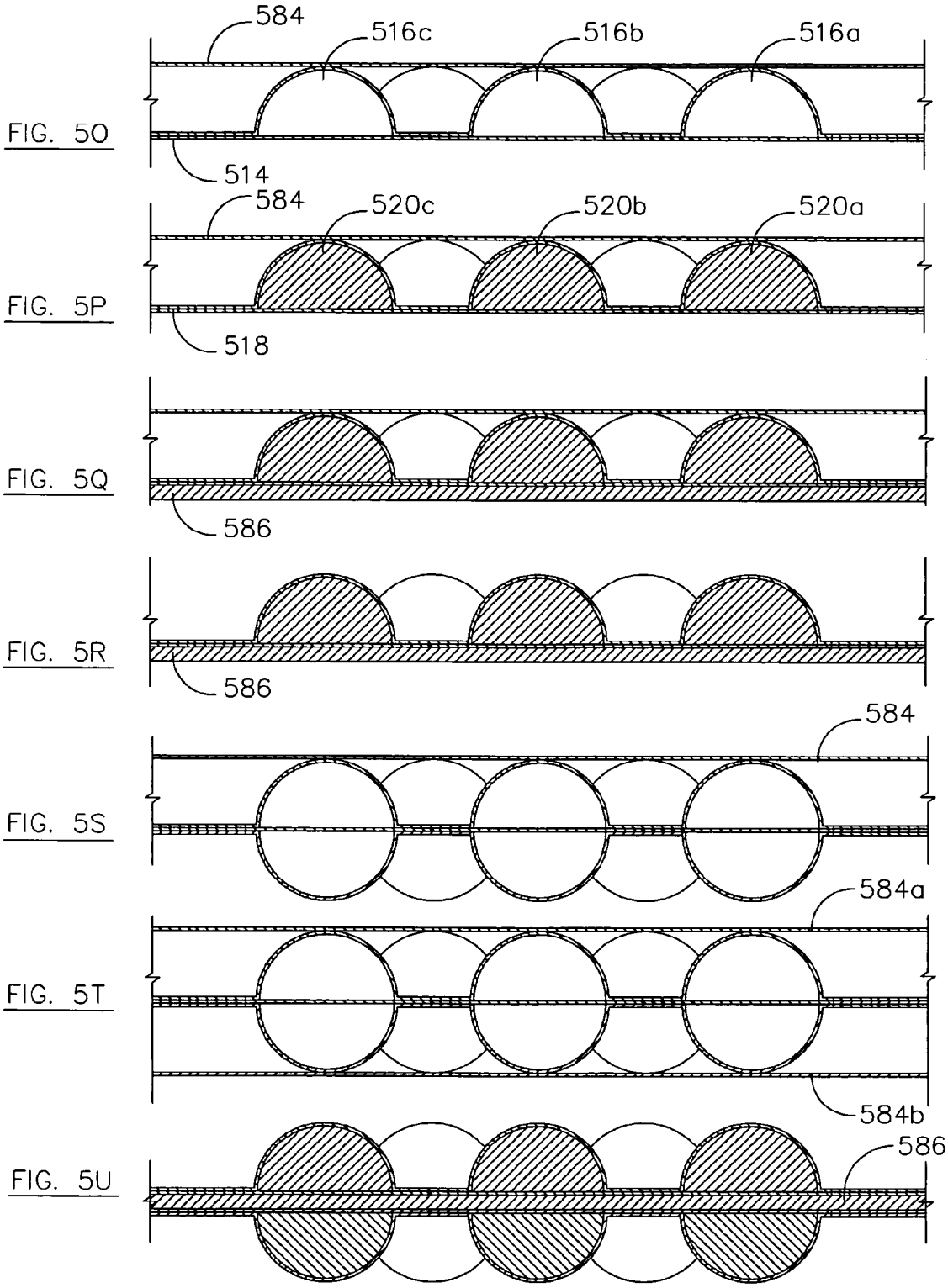

FIG. 5O illustrates an embodiment similar to the embodiment of FIG. 5D, although an additional protective or insulative layer 584 is applied to the exposed cells. FIG. 5P similarly shows an additional layer 584 applied to an insulator that is similar to that of FIG. 5E. In addition, one or more foam layers may be applied to the insulators of the present invention. For example, FIG. 5Q illustrates the insulator of FIG. 5P with an additional foam layer 586.

FIG. 5R shows a similar layer 586 applied to the insulator of FIG. 5D.

The additional layer 584 may also be applied to the double cell embodiments. Thus, FIG. 5S illustrates an additional layer 584 applied to the insulator of FIG. 5K; and FIG. 5T illustrates two additional layers 584*a*, 584*b* applied to the insulator of FIG. 5K. Additionally, a central foam layer may be provided between cell layers, as shown in FIG. 5U. More particularly, as shown, the foam layer 586 is shown between individual layers, such as those of FIG. 5E. Such an embodiment may also have the cell side covered by an additional substrate layer.

Figure 5V:
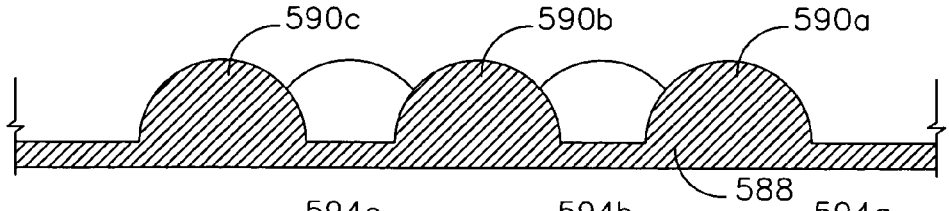

Also, various embodiments may be formed of a foam material. For example, as shown in FIG. 5V, a foam substrate 588 may be provided, with cells 590*a*-590*c* formed therein. The foam material may itself be dense, having little or no inherent cell structure, or may be a relatively more open cell material.

Figure 5W:
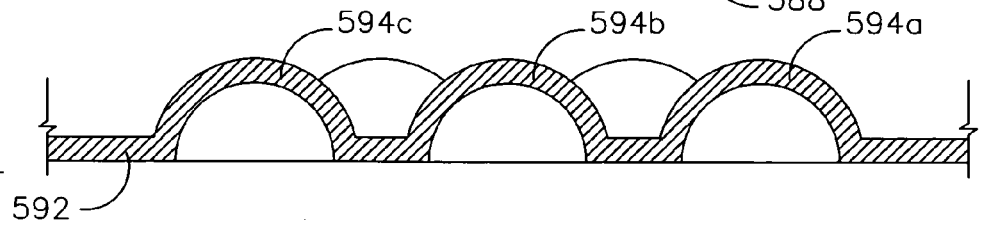
Figure 5X:
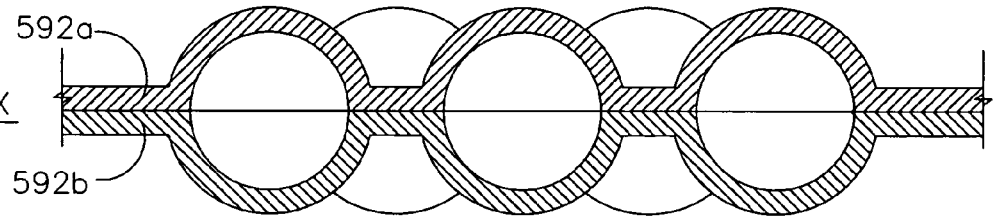

Similarly, FIG. 5W illustrates a foam substrate 592 having cells 594*a*-594*c* formed integrally thereon. FIG. 5X is similar, though includes two substrates 592*a*, 592*b* forming a double-sided cell structure.

Figure 5Y:
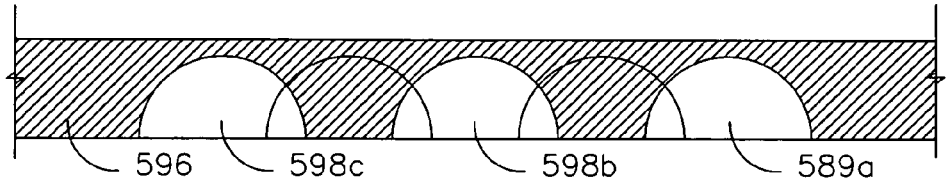
Figure 5Z:
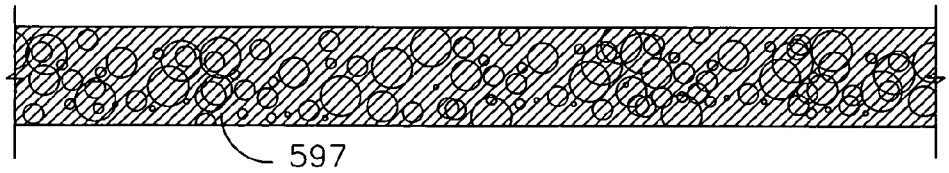
Figure 5A:
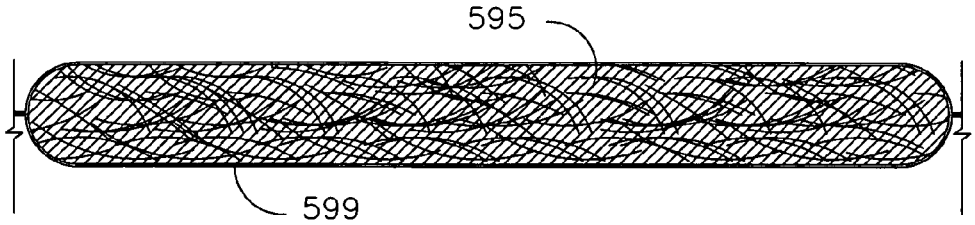

FIG. 5Y illustrates another embodiment using a foam substrate 596. In this embodiment, the cells 598*a*-598*c* are formed within the substrate. In FIG. 5Z, a substrate 597 is provided, having an open, random cell structure, although a relatively more dense substrate having few if any inherent cells may also be used.

Finally, FIG. 5AA illustrates in greater detail an insulator 599 in which each sub-panel is itself a single cell 595.

Figure 6A:
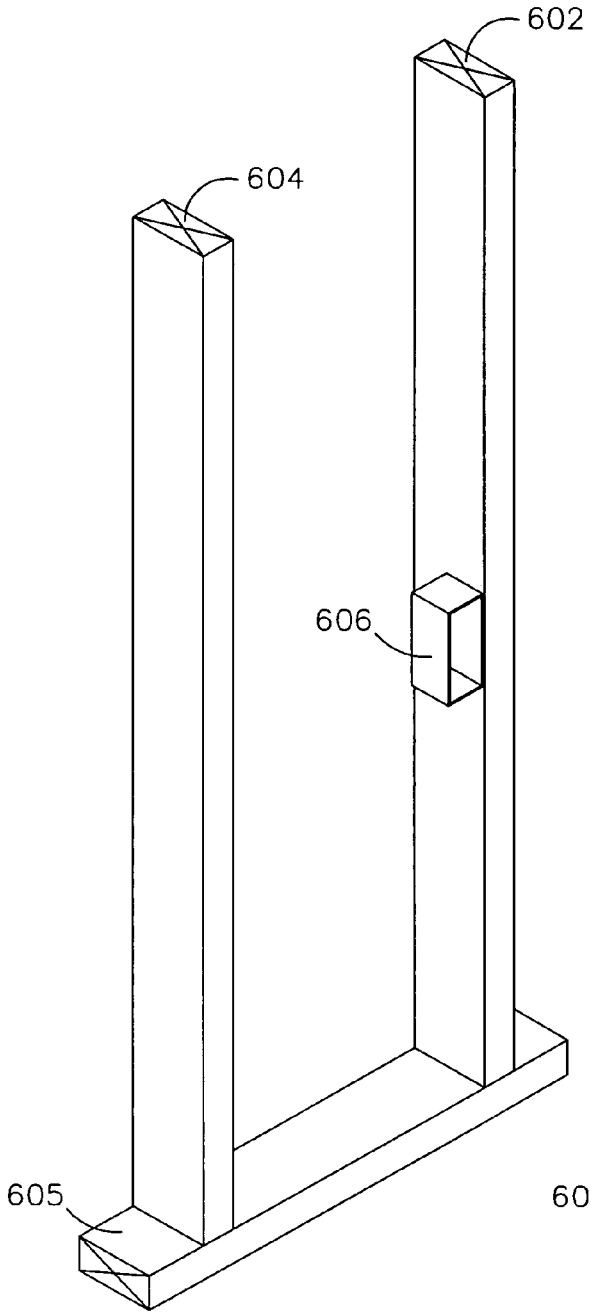
FIG. 6A and FIG. 6B illustrate use of an insulator having predetermined filled cells.

As noted above, in certain embodiments, the cells may be filled with or made out of an insulating material other than air. As can be appreciated, use of such materials can increase the rigidity of the resulting insulating panels, which can be disadvantageous when installing the panels, particularly when there are obstructions which must be avoided. For example, shown in FIG. 6A is a pair of studs 602, 604 and a base plate 605. A junction box 606, exemplary of an obstruction, is placed along one stud 602.

Figure 6B:
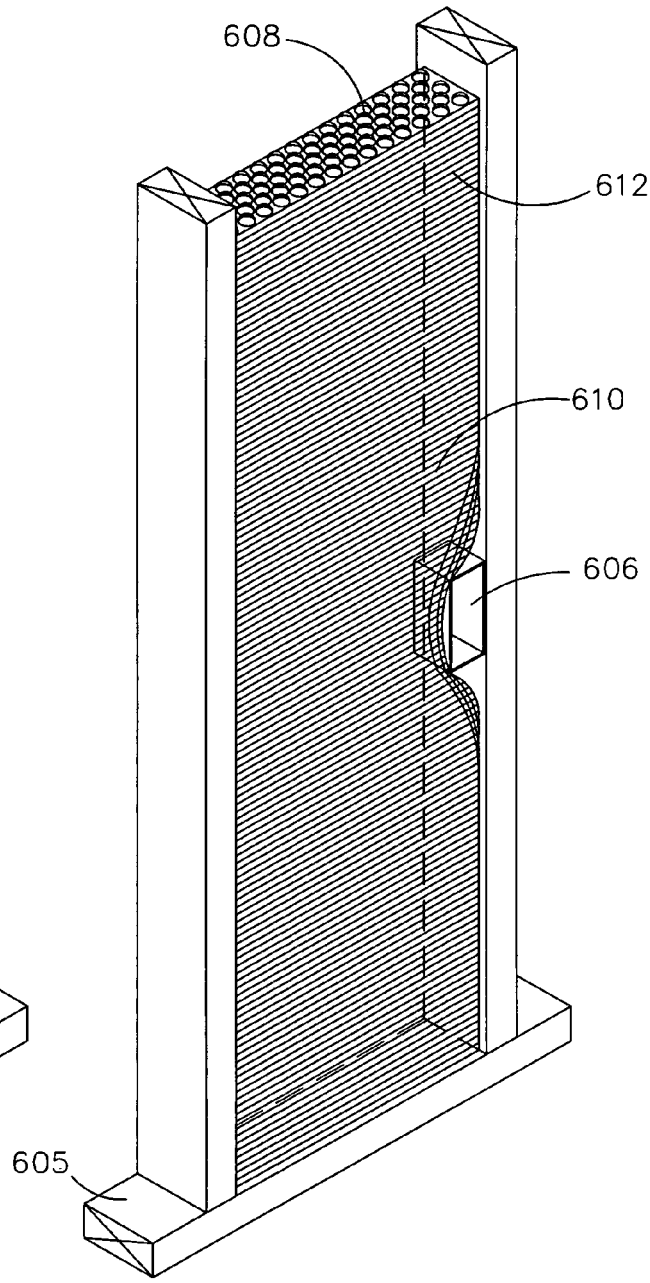

As shown in FIG. 6B, an insulating panel 608 may be placed in position between the studs 602, 604. As shown, the panel 608 may be molded around the obstruction. As will be explained in greater detail below, the panel 608 may include a non-filled cell portion 610 and a filled cell portion 612 for easier installation. That is, the non-filled cell portion has a greater flexibility than the filled cell portion and thus is more easily manipulated around the obstruction. It is noted that in alternate embodiments, a uniformly filled cell structure is provided, which can easily be cut in the field using, for example, a utility knife.

Figure 7A:
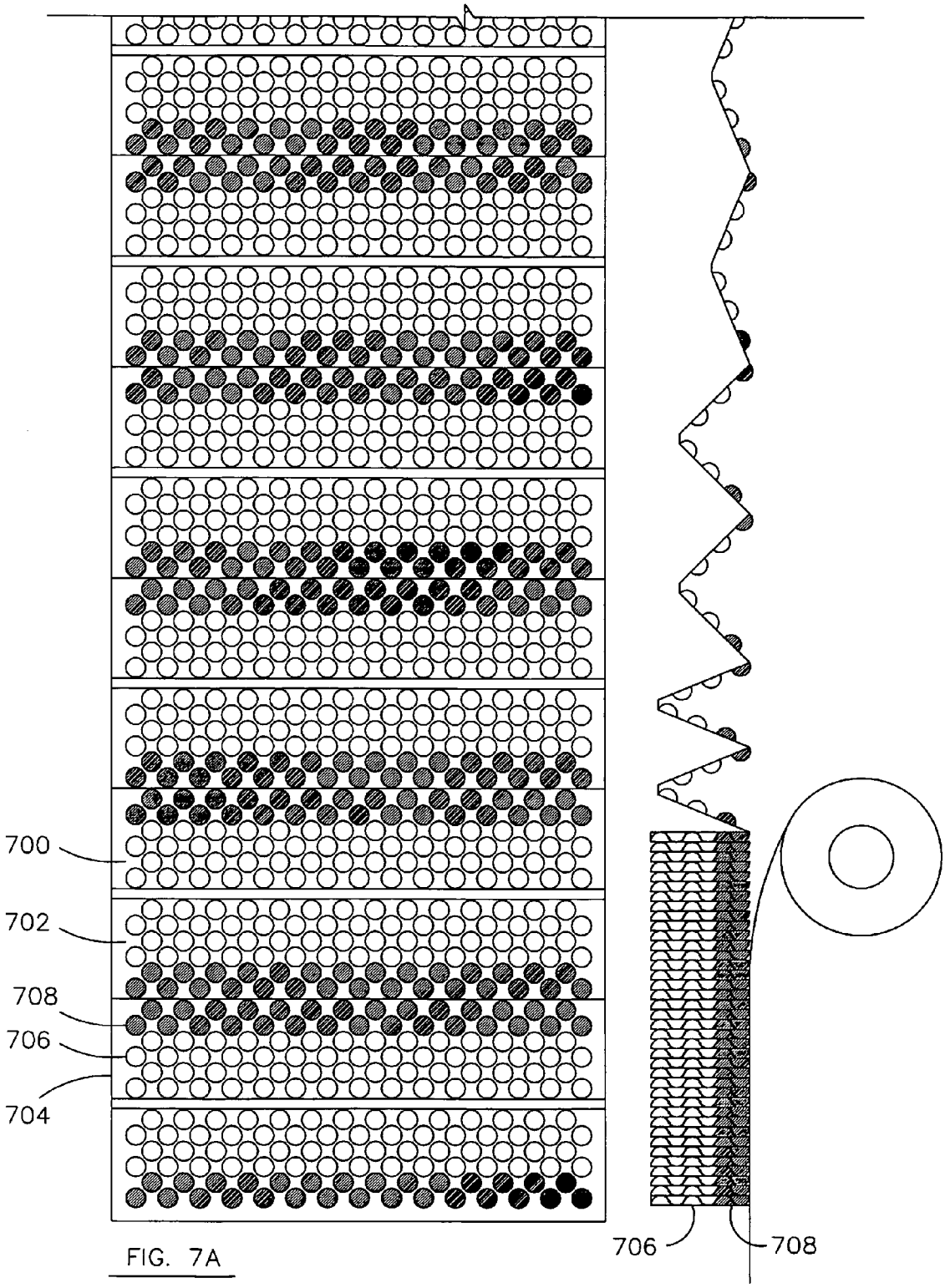
FIG. 7A and FIG. 7B illustrate insulating panels having filled cells according to an embodiment of the present invention.
Figure 7B:
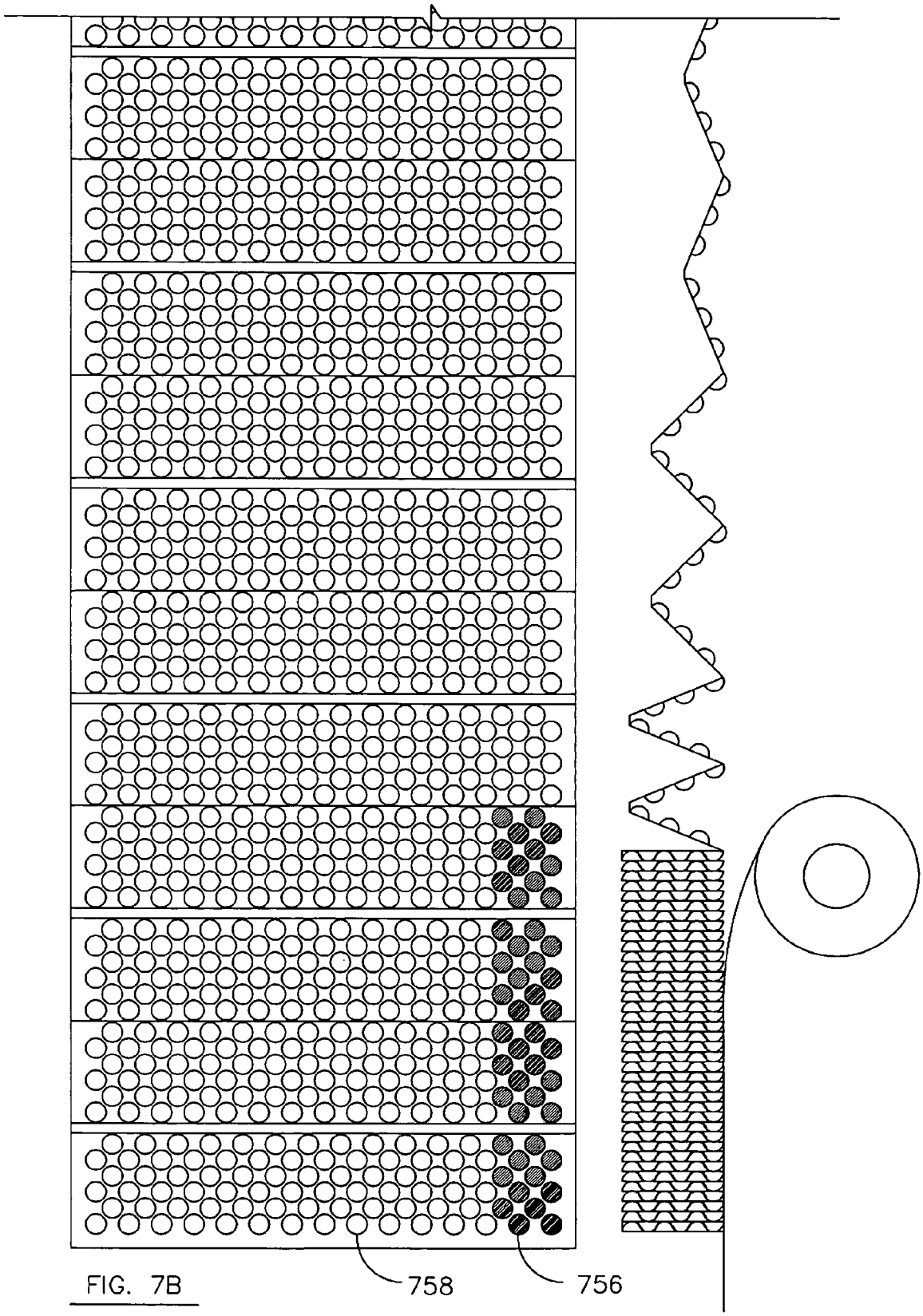

FIG. 7A and FIG. 7B illustrate exemplary insulating panels with patterns of filled and non-filled cells. It is noted, however, that other patterns are contemplated. Thus, the figures are exemplary only. Shown in FIG. 7A is a substrate 700 having a plurality of sub-panels 702, 704. The sub-panels 702, 704 may be generally configured as shown in FIG. 3. An exemplary sub-panel 704 includes a pattern of non-filled cells 706 and a pattern of filled cells 708. Such a configuration allows for a completed insulating panel that has greater flexibility at 706.

FIG. 7B illustrates another insulating panel having filled and non-filled cells. Shown is substrate 750 and a plurality of sub-panels 752, 754. Again, the sub-panels 752, 754 may be generally configured as shown in FIG. 3. An exemplary sub-panel 752 includes filled cells 756 and non-filled cells 758. Such a configuration allows for greater rigidity at the filled cells 756 and more flexibility at the non-filled cells 758.

It is noted that, in such embodiments, not all of the sub-panels need to have the same pattern of filled and non-filled cells. For example, it may be desirable to have the flexibility only at a predetermined height along a side of the insulating panel, and not all the way along an entire edge.

The invention described in the above detailed description is not intended to be limited to the specific form set forth herein, but is intended to cover such alternatives, modifications and equivalents as can reasonably be included within the spirit and scope of the appended claims.

What is claimed is:

1. An insulator, comprising:

a foldable substrate;

insulating sub-panels formed on said substrate and positioned between predetermined creases, said sub-panels each including a plurality of insulating cells;

wherein adjacent ones of said sub-panels are folded in a substantially accordion-like structure and adjacently substantially permanently secured to one another in a face-to-face fashion, such that insulating cells associated with opposing faces are substantially interleaved.

2. An insulator in accordance with claim 1, comprising pairs of creases between each of said sub-panels.

3. An insulator in accordance with claim 1, said cells formed on a first surface of said substrate.

4. An insulator in accordance with claim 3, said cells formed on a second surface of said substrate.

5. An insulator in accordance with claim 1, wherein pairs of said sub-panels comprise complementary spaced cells such that, when folded in said stacked accordion-like structure, cells on opposing panels are substantially adjacent and define a substantially uniform insulating barrier.

6. An insulator in accordance with claim 1, wherein said sub-panels are adhesively adhered to one another.

7. An insulator in accordance with claim 1, wherein said sub-panels are secured to one another by one or more facing layers applied to the substantially accordion-like structure.

8. An insulator in accordance with claim 1, wherein predetermined numbers of said cells are filled with an insulating material other than air.

9. An insulator in accordance with claim 1, wherein pluralities of cells include different materials such that portions of said insulator have different rigidities.

10. An insulator, comprising:

a substrate adapted to be folded, forming one or more creases;

insulating sub-panels formed on said substrate and positioned between predetermined creases, said sub-panels each including a plurality of insulating cells;

wherein said sub-panels are folded in a substantially accordion-like structure and adjacently adhered to one another face-to-face in a substantially permanent fashion.

11. An insulator in accordance with claim 10, comprising pairs of creases between each of said sub-panels.

12. An insulator in accordance with claim 10, said cells formed on a first surface of said substrate.

13. An insulator in accordance with claim 12, said cells formed on a second surface of said substrate.

14. An insulator in accordance with claim 10, wherein pairs of said sub-panels comprise complementary spaced cells such that, when folded in a stacked accordion-like structure, cells on opposing panels are substantially adjacent and define a substantially uniform insulating barrier.

15. An insulator in accordance with claim 10, said cells being cells in an open-celled membrane.

16. An insulator in accordance with claim 10, said substrate being a closed-celled membrane.

17. An insulator in accordance with claim 10, wherein said sub-panels are adhesively adhered to one another.

18. An insulator in accordance with claim 10, wherein said sub-panels are secured to one another by one or more facing layers applied to the substantially accordion-like structure.

19. An insulator in accordance with claim 10, wherein predetermined numbers of said cells are filled with an insulating material other than air.

20. An insulator in accordance with claim 10, wherein pluralities of cells include different materials such that portions of said insulator have different rigidities.

21. An insulator, comprising:

a substrate folded in a stacked accordion-like structure, forming one or more creases; and insulating sub-panels formed on said substrate and positioned between creases;

wherein pairs of said sub-panels comprise a plurality of complementary spaced cells such that, when folded in said stacked accordion-like structure, the sub-panels are substantially adjacently Permanently secured to one another face-to-face and define a substantially uniform insulating barrier, each of said sub-panels including a plurality of cells.

22. An insulator in accordance with claim 21, wherein said sub-panels are adhesively adhered to one another.

23. An insulator in accordance with claim 21, wherein said sub-panels are secured to one another by one or more facing layers applied to the stacked accordion-like structure.

24. An insulator in accordance with claim 21, wherein predetermined numbers of said cells are filled with an insulating material other than air.

25. An insulator in accordance with claim 21, wherein pluralities of cells include different materials such that portions of said insulator have different rigidities.

* * * * *